US008821322B1

(12) United States Patent
Jorgens et al.

(10) Patent No.: US 8,821,322 B1
(45) Date of Patent: Sep. 2, 2014

(54) ADJUSTABLE BATTING TEE HAVING A REMOVABLY ATTACHABLE BASE MECHANISM

(71) Applicant: Wilson Sporting Goods Co., Chicago, IL (US)

(72) Inventors: David A. Jorgens, Truckee, CA (US); Timothy D. Greene, Reno, NV (US); Jose L. Lopez, Reno, NV (US)

(73) Assignee: Wilson Sporting Goods Co., Chicago, IL (US)

( * ) Notice: Subject to any disclaimer, the term of this patent is extended or adjusted under 35 U.S.C. 154(b) by 65 days.

(21) Appl. No.: 13/800,343

(22) Filed: Mar. 13, 2013

(51) Int. Cl.
*A63B 69/00* (2006.01)

(52) U.S. Cl.
CPC ..... *A63B 69/0075* (2013.01)
USPC ..... 473/417

(58) Field of Classification Search
CPC ..... A63B 69/0073; A63B 69/0075; A63B 69/0002; A63B 2069/0008; A63B 2225/093; A63B 71/023
USPC ..... 473/417–420, 427, 429, 451
See application file for complete search history.

(56) References Cited

U.S. PATENT DOCUMENTS

| | | | | | |
|---|---|---|---|---|---|
| 2,456,480 | A | | 12/1948 | Austin | 248/351 |
| 4,934,319 | A | | 6/1990 | Waltemeyer | 119/52.2 |
| 4,993,708 | A | * | 2/1991 | Prossor et al. | 473/417 |
| 5,320,343 | A | | 6/1994 | McKinney | 273/26 |
| 5,566,926 | A | | 10/1996 | Voigt | 256/13.1 |
| 5,636,823 | A | | 6/1997 | Boyd | 248/414 |
| 5,916,045 | A | * | 6/1999 | Busch | 473/417 |
| 5,967,910 | A | * | 10/1999 | Lin | 473/417 |
| D451,566 | S | | 12/2001 | De Chenne | D21/717 |
| 6,358,163 | B1 | | 3/2002 | Tanner | 473/417 |
| 6,682,445 | B1 | | 1/2004 | Tanner | 473/417 |
| 6,884,185 | B2 | | 4/2005 | Udwin et al. | 473/417 |
| 6,893,363 | B1 | * | 5/2005 | Chen et al. | 473/417 |
| 7,281,998 | B2 | | 10/2007 | Tanner | 473/417 |
| 2003/0036446 | A1 | * | 2/2003 | Udwin et al. | 473/417 |
| 2006/0258485 | A1 | * | 11/2006 | Bandimere et al. | 473/417 |
| 2011/0218058 | A1 | * | 9/2011 | Gangelhoff | 473/417 |
| 2012/0165136 | A1 | * | 6/2012 | Durham et al. | 473/417 |
| 2013/0210554 | A1 | * | 8/2013 | Carlson | 473/417 |

FOREIGN PATENT DOCUMENTS

| | | | |
|---|---|---|---|
| JP | 2012-000417 A | 1/2012 | A63B 69/00 |

* cited by examiner

*Primary Examiner* — Mark Graham
(74) *Attorney, Agent, or Firm* — Terence P. O'Brien

(57) ABSTRACT

An adjustable portable batting tee assembly for placement on to a horizontal support surface includes a first hollow tubular post having a lower end and an inner surface, a second tubular post telescopically engaging the first tubular post, a first felt piston wiper, a ball support coupled to the second tubular post, a post mount mechanism, and a base coupled to the mount mechanism. The first wiper is positioned between the first and second posts to enable adjustment of the height of the batting tee assembly between a lower and upper height limits. The mount mechanism includes a support body, an expansion plug and upper and lower fastening elements. The expansion plug and the upper fastening element are configured to be removably received within the lower end of the first tubular body. The expansion plug is configured to releasably engage the inner surface of the first tubular post.

23 Claims, 7 Drawing Sheets

ADJUSTABLE BATTING TEE HAVING A REMOVABLY ATTACHABLE BASE MECHANISM

FIELD OF THE INVENTION

The present invention relates generally to a portable, adjustable batting tee having a removably attachable base.

BACKGROUND OF THE INVENTION

Batting tees for baseball and softball training are well known and typically include a large base, an upwardly extending post and a ball support. Batting tees configured for use for players above entry level must address certain design challenges.

During use, players will often impact the top portions of the tee with their bats. The forces generated by a ball bat when swung are significant. Batting tees must be sufficiently tough and durable to withstand the severe impact forces of repeated bat impacts. Further, batting tees are often used by teams, coaches, schools and other organizations. As a result, batting tees typically receive a significant amount of use overtime. Accordingly, batting tees designed for players above entry level are typically designed to be heavy, large and durable.

Some batting tees are configured to allow the height of the tee to be adjusted. In some designs, the height adjustment is accomplished through use of wearable elastomeric members to provide an interference fit. Other designs use fasteners or releasable levers to allow the length of the post to be extended. Such designs typically involve either removing fasteners or repositioning levers in order to change the height of the post. These designs require multiple steps, the use of at least two hands, and in some instances tools to complete the adjustment. Other tee designs utilizing interference fits wear easily, have reduced useful product lives and become non-functional overtime for all heights except the lowest setting.

Batting tees designed for entry level baseball and softball players can be lighter and are often configured for use with a hollow plastic "whiffle" style bats, or very light baseball and softball bats. Such tees are not configured to withstand the impacts and use of typical more advanced ball players, and would quickly fail under such use.

Accordingly, a need exists for a batting tee that is lightweight, durable and easy to use. What is needed is a batting tee that allows for consistent, quick and easy height adjustments over a large adjustment range without degrading overtime. What is needed is a portable batting tee that can be quickly and easily disassembled for transportation in a vehicle or between practice locations. It would be advantageous to provide a batting tee that has pleasing aesthetics. It would also be advantageous to provide a batting tee that provides these characteristics at a reasonable price point.

SUMMARY OF THE INVENTION

The present invention provides a portable batting tee assembly including first and second tubular posts, a ball support, a base, and a post mount mechanism. The first tubular post has a lower end, an upper end and an inner surface. The second tubular post telescopically engages the first tubular post. The ball support is coupled to the second tubular post. The post mount mechanism includes a support body, an expansion plug and upper and lower fastening elements. The support body includes a cylindrical bearing portion and a base engaging portion connected to the base. The bearing portion, the expansion plug and the upper fastening element are configured to be removably received within the lower end of the first tubular body. The post mount mechanism is removably attachable to the first tubular post in first and second positions. In the first position, the bearing portion, the expansion plug and the upper fastening element are positioned within the lower end of first tubular support and the outer diameter of the expansion plug bears against the inner surface of the first tubular post to fixedly secure the lower end of the first tubular support to the mount mechanism, and in the second position, the first tubular post is movable with respect to, and separable from, the bearing portion and the expansion plug.

According to a principal aspect of a preferred form of the invention, an adjustable portable batting tee assembly for placement on to a horizontal support surface includes a first hollow tubular post, a second tubular post, a first felt piston wiper, a ball support, a post mount mechanism, and a base. The first hollow tubular post has a lower end and an inner surface. The second tubular post telescopically engages the first tubular post. The first felt piston wiper is positioned between the first and second tubular posts to enable adjustment of the height of the batting tee assembly between a plurality of heights with respect to the support surface between a lower height limit and an upper height limit. The ball support is coupled to the second tubular post. The post mount mechanism includes a support body, an expansion plug and upper and lower fastening elements. The expansion plug and the upper fastening element are configured to be removably received within the lower end of the first tubular body. The expansion plug is configured to releasably engage the inner surface of the first tubular post. The base is coupled to the post mount mechanism.

This invention will become more fully understood from the following detailed description, taken in conjunction with the accompanying drawings described herein below, and wherein like reference numerals refer to like parts.

DETAILED DESCRIPTION OF THE PREFERRED EMBODIMENTS

Figure 1:
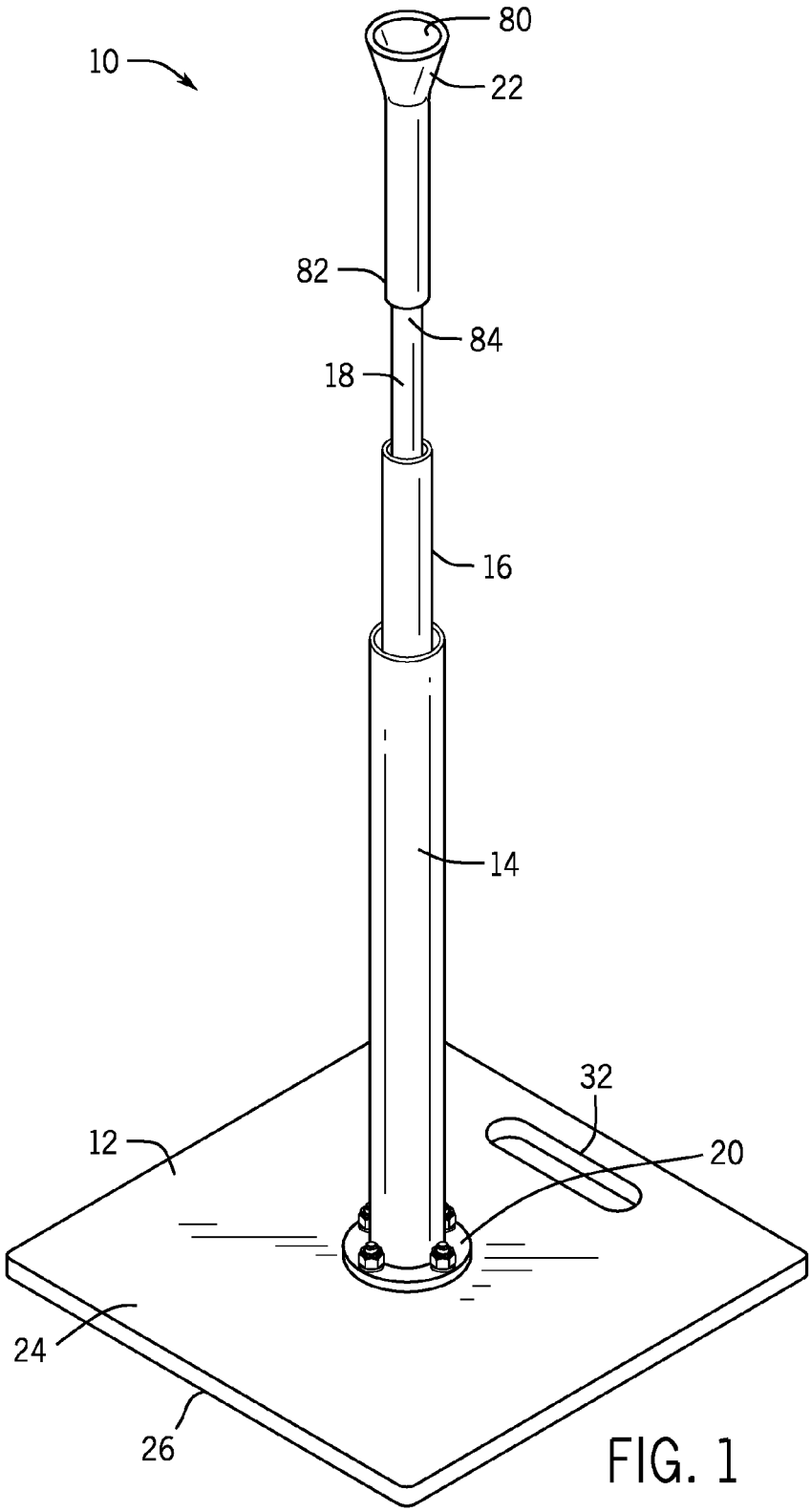
FIG. 1 is a side, top perspective view of a batting tee assembly in accordance with a preferred embodiment of the present invention.
Figure 2:
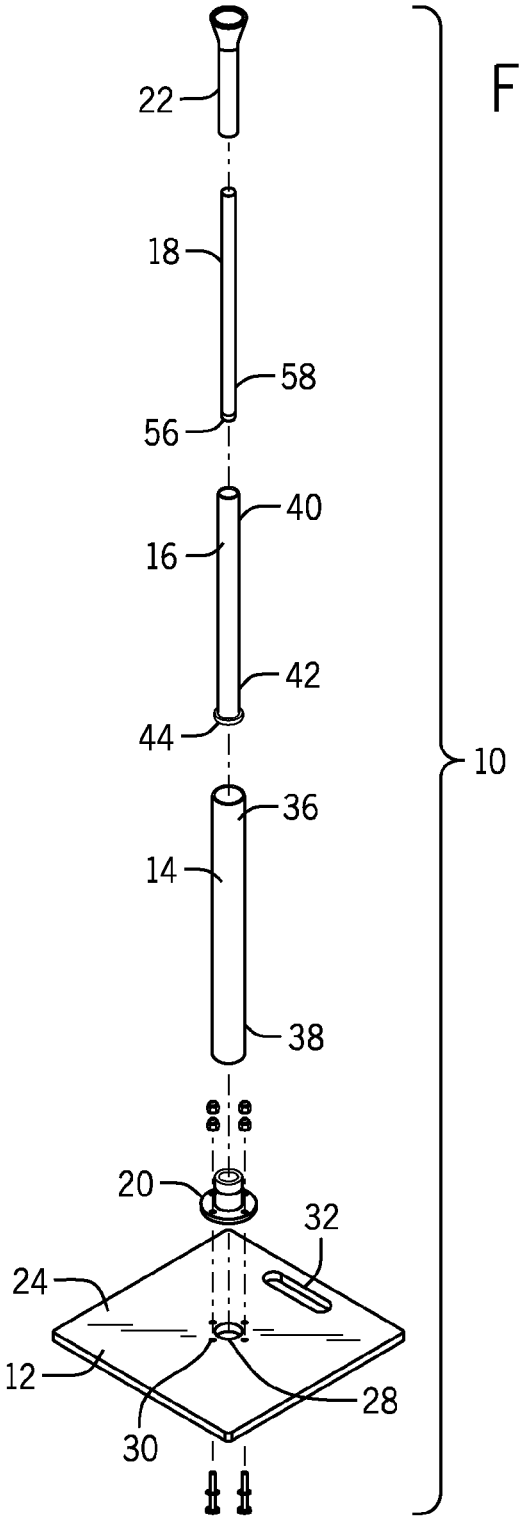
FIG. 2 is a side top exploded view of the batting tee assembly of FIG. 1.

Referring to FIGS. 1 and 2, a portable, adjustable batting tee assembly 10 for supporting a baseball or softball is shown. The tee assembly 10 includes a base 12, first, second and third tubular posts 14, 16 and 18, a post mount mechanism 20 and a ball support 22. The tee assembly 10 allows for easy, efficient and consistent height adjustments, quick disassembly and reassembly of the post 14 from the base 12, and ease of transport between practice locations.

The base 12 is a durable, rigid generally planar member configured for placement onto a horizontal surface such as a ball field, home plate, or indoor practice surface. The base 12 provides lightweight, stable support for the tee assembly 10 that resists tipping over during use. The base 12 is preferably formed of a durable, wear-resistant and relatively lightweight material, such as, for example, a high density polyethylene. In alternative preferred embodiments, the base can be formed of other materials including other polymeric materials, other plastics, fiber composite materials, aluminum, other metallic alloys, wood, a high density thermoplastic material, a thermoset material, and combinations thereof. The base 12 has upper and lower surfaces 24 and 26, and includes a mount opening 28 for receiving the post mount mechanism 20. In one preferred embodiment, the base 12 has a rectangular shape, and the mount opening 24 is centrally positioned within the base 12. The base 12 can also include one or more fastener openings 30 for facilitating the engagement of the post mount mechanism 20 to the base 12. The base 12 can also include a handle 32 facilitating the transport of the base 12, the base 12 and post mount mechanism 20, or the tee assembly 10 as a whole. In one preferred embodiment, the handle 30 is defined by an elongate through-base opening in the base 12. The handle 32 enables a player or coach to quickly and easily grasp the base 12 for repositioning or transport. In other alternative embodiments, the handle can have other configurations. For example, the handle can be two or more through-base openings, one or more non-through wall recesses in the top or bottom surfaces of the base, one or more structures attached to the base, or combinations thereof.

Figure 3:
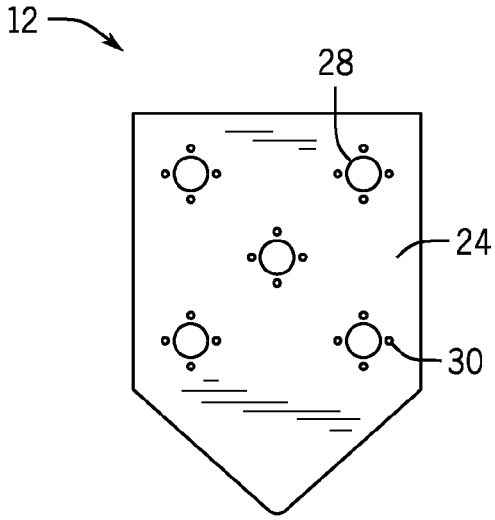
FIG. 3 is top view of a base of a batting tee assembly in accordance with an alternative preferred embodiment of the present invention.

Referring to FIG. 3 in an alternative preferred embodiment, the base 12 can be formed in the shape of home plate. Additionally, the base 12 can be formed with multiple mount openings 28 for removably receiving and engaging the mount mechanism 20. The additional mount openings 28 enable the player to simulate hitting an inside pitch, an outside pitch or a pitch down the middle of the plate. In other alternative embodiments, other numbers of mount openings can be used, or alternative structures can be employed for removably engaging the first tubular post.

Figure 4:
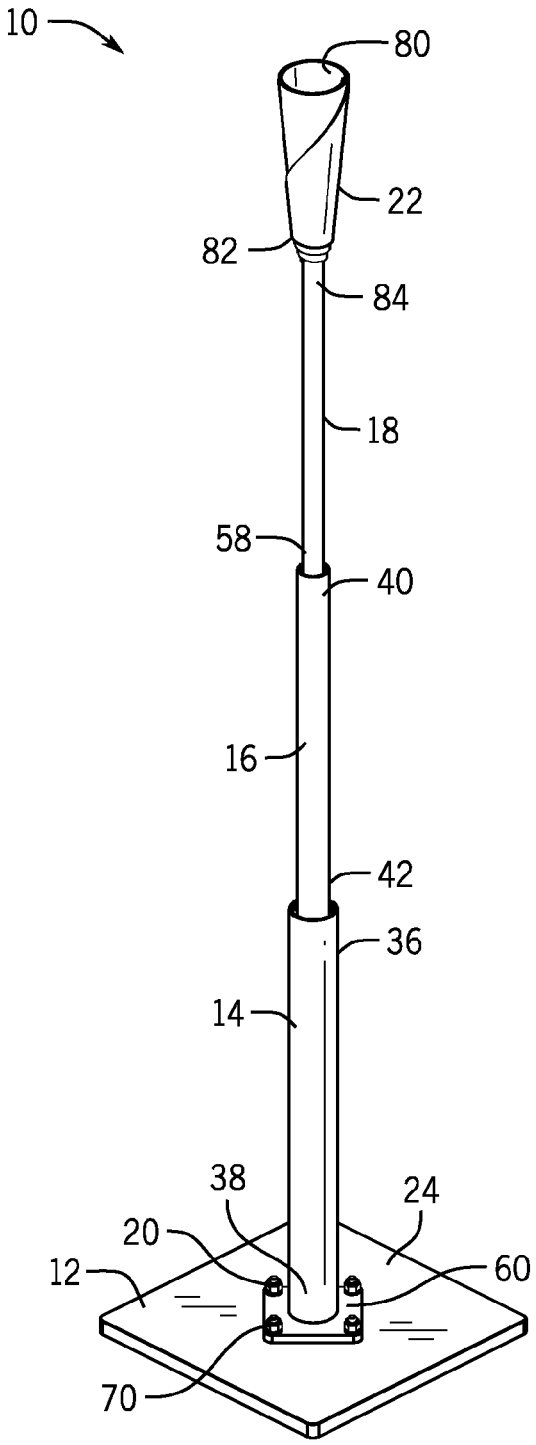
FIG. 4 is a side, top perspective view of a fully extended batting tee assembly in accordance with an alternative preferred embodiment of the present invention.
Figure 6:
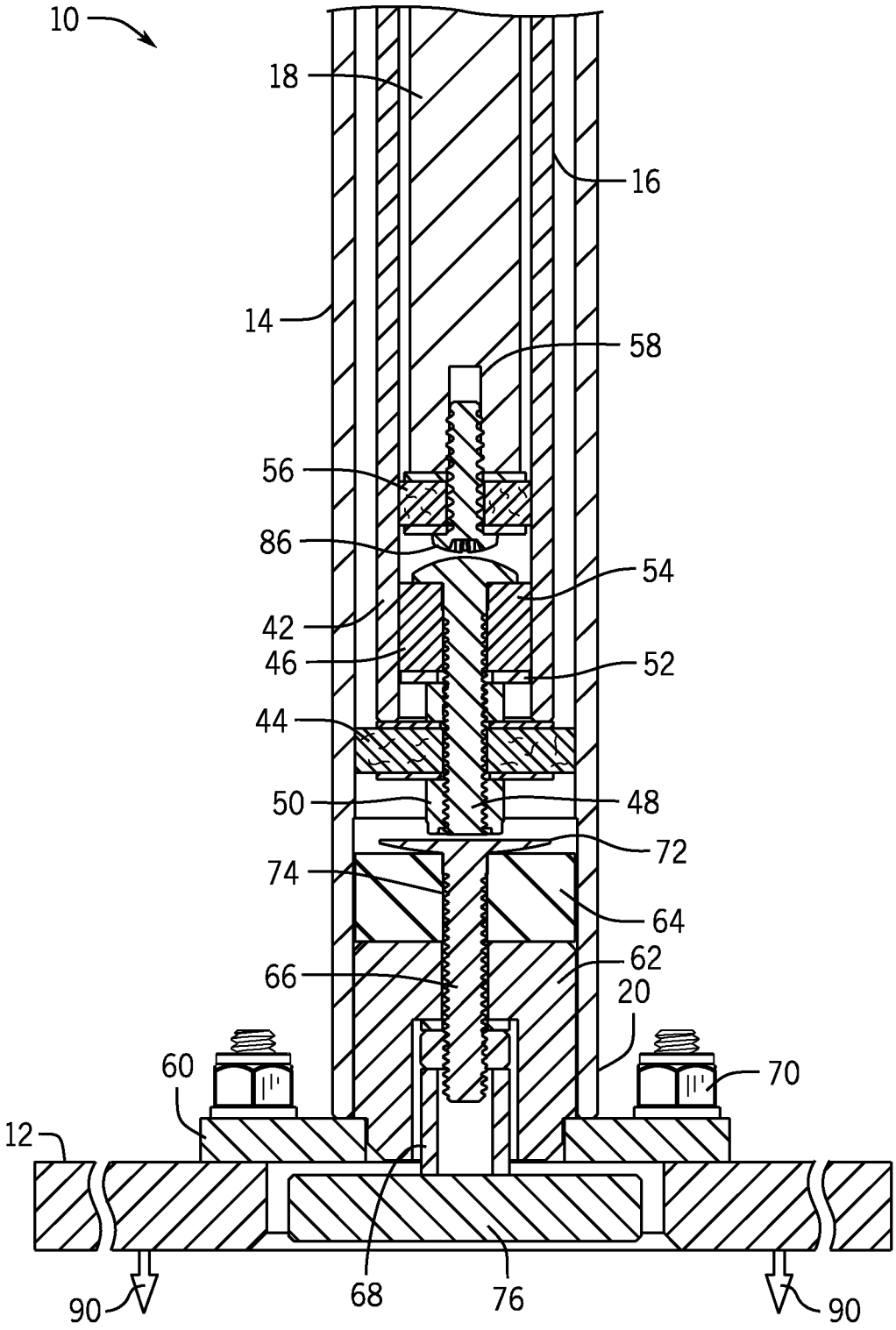
FIG. 6 is a longitudinal sectional view of the batting tee assembly of FIG. 4.
Figure 7:
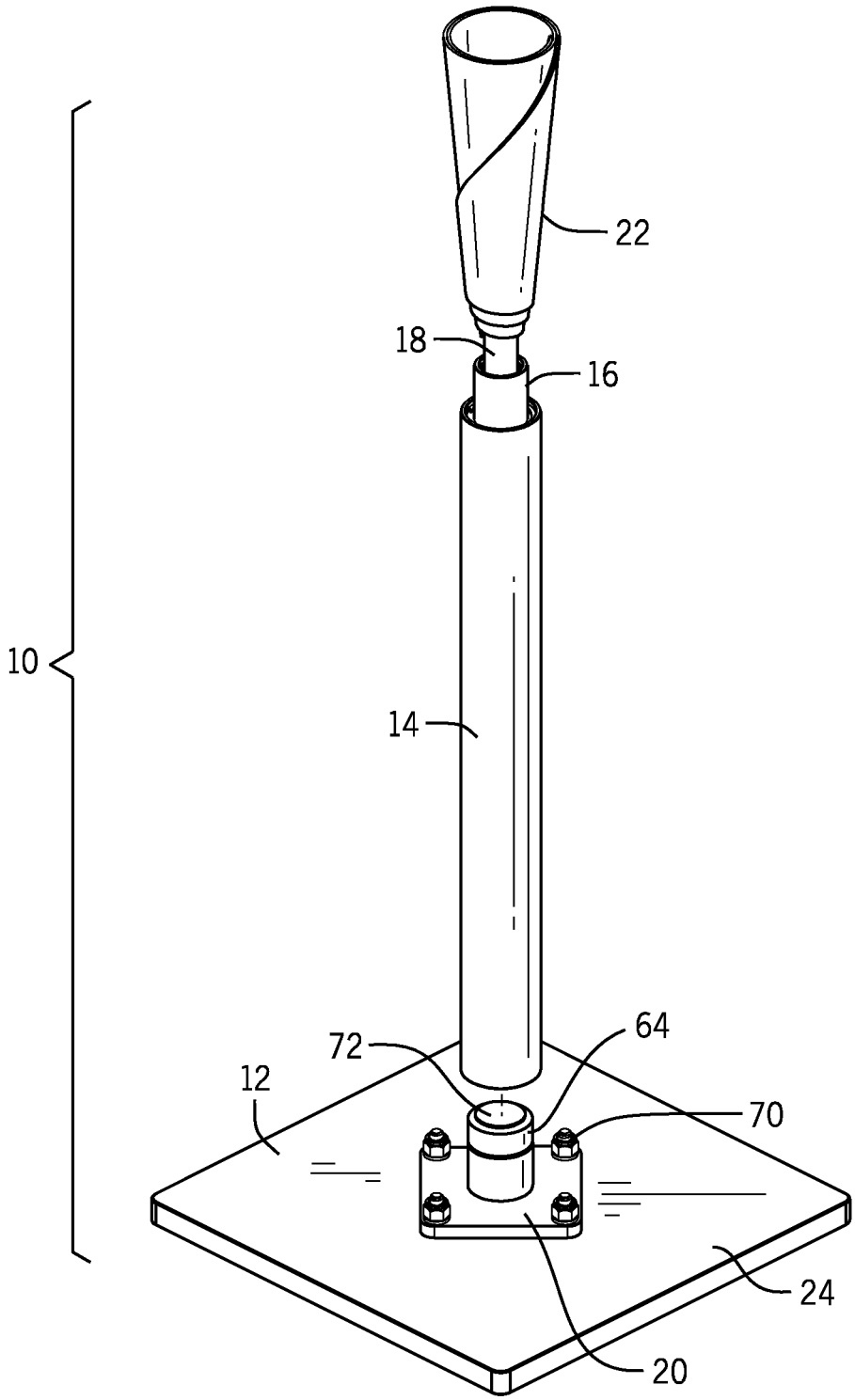
FIG. 7 is a view of a first tubular post separated from a mount mechanism of the batting tee assembly of FIG. 4.
Figure 8:
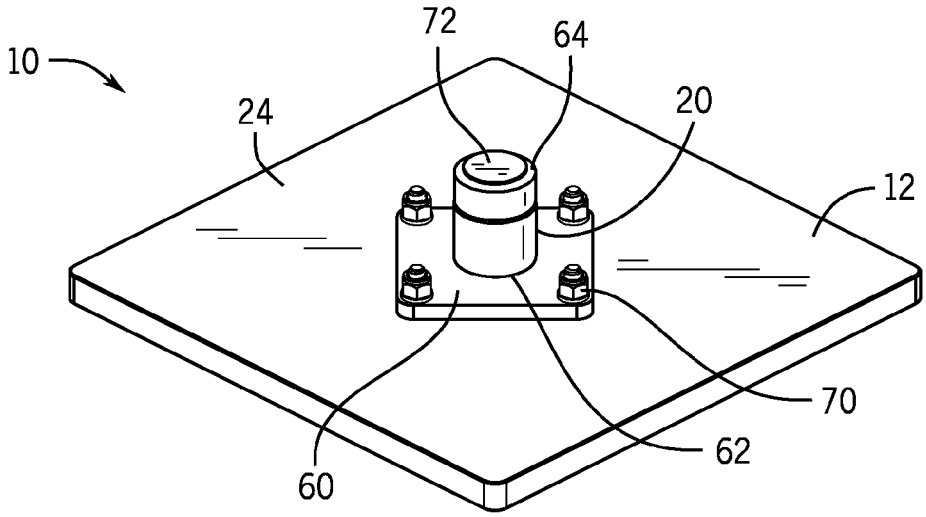
FIG. 8 is a top side perspective view of the mount mechanism and the base of the batting tee assembly of FIG. 4.
Figure 9:
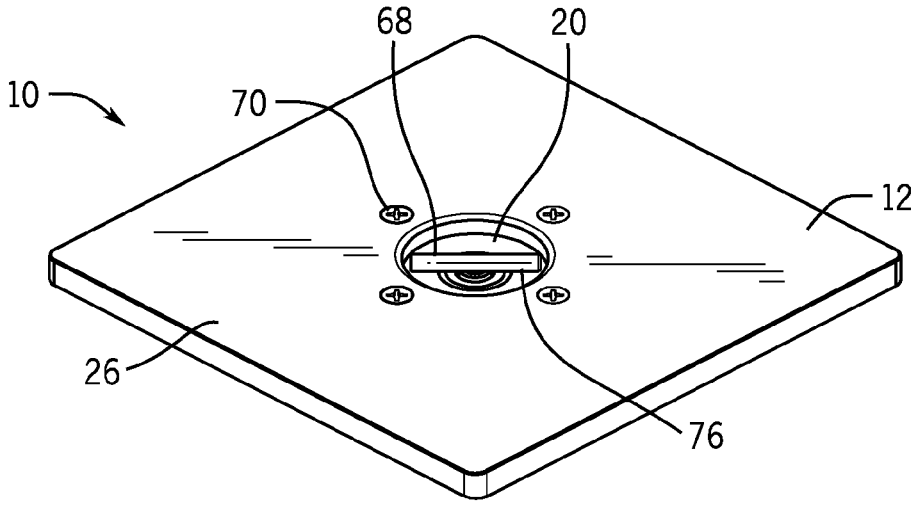
FIG. 9 is a bottom side perspective view of the base of the batting tee assembly of FIG. 4.

Referring to FIG. 4, an alternative preferred embodiment of the tee assembly 10 is illustrated. The base 12 is shown in a square shape and is formed without a handle. The base 12 can be sized to define a footprint of less than or equal to one square foot. In other embodiments, the base can have a larger size defining a larger footprint. In other alternative preferred embodiments, the base can be formed in other shapes, such as, for example, other rectangular shapes, other polygonal shapes, circular shapes, irregular curved shapes, and other irregular shapes. Referring to FIG. 6, in an alternative preferred embodiment, the base 12 can include one or more spikes 90 for securing the base 12 into the ground for outdoor use. The spikes 90 can be fixedly secured to the base or removable.

Referring to FIGS. 1, 2, 4 and 6, the first, second and third tubular posts 14, 16 and 18 are illustrated. The first, second and third tubular posts 14, 16 and 18 are elongate structures preferably telescopically engaged with each other. The first and second posts 14 and 16 are preferably hollow tubes, and the third post 18 is a solid pole member. The first post 14 includes upper and lower ends 36 and 38 with the lower end 38 removably engaged with the post mount mechanism 20. The second post 16 includes upper and lower ends 40 and 42, respectively, and is sized to extend within the first post 14 such that the second post 16 upwardly and outwardly extends from the upper end 36 of the first post 14. The first and second posts 14 and 16 preferably have a uniform outer diameter, inner diameter and wall thickness along their lengths. In alternative preferred embodiments, the first and second posts 14 and 16 can have a tapered or frustoconical shape, and the inside and/or outside diameters and the wall thickness of the first and second posts can vary along their lengths. The first and second posts 14 and 16 are preferably formed of a lightweight, high impact strength material such as, for example, aluminum. In alternative preferred embodiments, the first and second posts can be formed of other materials including fiber composite materials, acetal, other polymeric materials, thermoplastic materials, thermoset materials, and combinations thereof.

The upper end 40 of the second post 16 is coupled to the ball support 22. In one preferred embodiment, the third post 18 can be employed to couple the second post 16 to the ball support 22. In alternative preferred embodiment, the ball support 22 can be directly engaged to the second post 16 and the tee assembly 10 can be formed without the third post. In other alternative embodiments, the third post and one or more additional posts can be used to couple the second post to the ball support.

Referring to FIGS. 2 and 6, the first post 14 is preferably coupled to the second post 16 through the use of a first felt piston wiper 44. The wiper 44 generally centers the second post 16 within the first post 14 and allows for controlled telescoping movement and adjustment of the first and second posts 14 and 16. The wiper 44 can be connected to the lower end 42 of the second post 16 through use of a wiper fastening assembly 46. In one embodiment, the wiper fastening assembly 46 can include a bolt 48, a nut 50, a lower bearing surface 52, and an expansion plug 54. The wiper fastening assembly 46 fixes the wiper 44 to the lower end 42 of the second post 16. In alternative embodiments, other fastening configurations can be used. The felt piston wiper 44 is preferably formed of a dense F1 grade utility wool felt. The F1 grade felt is the highest quality felt providing a highly durable material, and enabling smooth consistent movement, positioning and repositioning of the second post 16 relative to the first post 14. The wiper 44 is sized with an outside diameter that is slightly larger than the inside diameter of the first post 14 to provide an interference fit between the first and second posts 14 and 16. The engagement of the outer surface of the wiper 44 with the inner surface of the first post 14 allows for smooth consistent movement along the longitudinal axis of the posts, and enables the tee to maintain its height at whatever location it is positioned in within its available range of telescoping movement. The F1 grade utility wool felt withstands dust, dirt and moisture well, and is highly wear resistant. The dense F1 grade felt wiper also provides stability to the batting tee 10 by providing additional side load support and increasing the ability of the batting tee 10 to withstand impacts with ball bats during use. In alternative embodiments, other grades of felt piston wipers can be used, and the wiper can be formed of other materials. In still other preferred embodiments, the wiper can be positioned at other locations between the first and second posts, or two or more wipers can be used between the first and second posts.

The third post 18 is a solid cylindrical rod formed of a lightweight, impact resistant material such as an acetal resin. In one particularly preferred embodiment, the third post can be formed of Delrin®, an acetal resin produced by Du Pont de Nemours International S.A. of Geneva, Switzerland. In other embodiments, the third post 18 can be formed of a nylon, a fiber composite material, aluminum, a thermoplastic material, or other high impact resistant materials. In another alternative embodiment, the third post can be a hollow tube, or a foam filled tube. The third post 18 is telescopically engaged with the second post 16 through a second felt piston wiper 56 coupled to a lower end 58 of the third post 18. An upper end 84 of the third post 18 can be connected to the ball support 22. The second felt wiper 56 can be fastened to the lower end 58 of the third post 18 through a fastener 86. In one preferred embodiment, the fastener 86 is a bolt extending through the felt wiper 56 and threadingly engaging the lower end 58 of the third post 18. In alternative preferred embodiments, the second felt wiper 56 can be coupled to the third post through other fastening configurations. The third post 18 preferably has a uniform outside diameter along its length and is spaced apart from the inner surface of the second post 16 by the second felt piston wiper 56. The second felt piston wiper 56 is substantially the same as the first felt piston wiper 44 but sized to operably engage the second and third posts 16 and 18. Referring to FIG. 2, the second post 16 can include a ring at its upper end 40 to limit the upward telescoping travel of the third post 18 within the second post 16. The second wiper 56 can contact the ring of the second post 16 thereby preventing further upward movement of the third post 18 relative to the second post 16. In an alternative preferred embodiment, the third post can have a tapered or frustoconical shape. In another alternative embodiment, the first, second and third posts 14, 16 and 18 and the first and second wipers 44 and 56 can take other shapes, such as, oval, rectangular, polygonal or other closed curved or irregular shapes.

Figure 5:
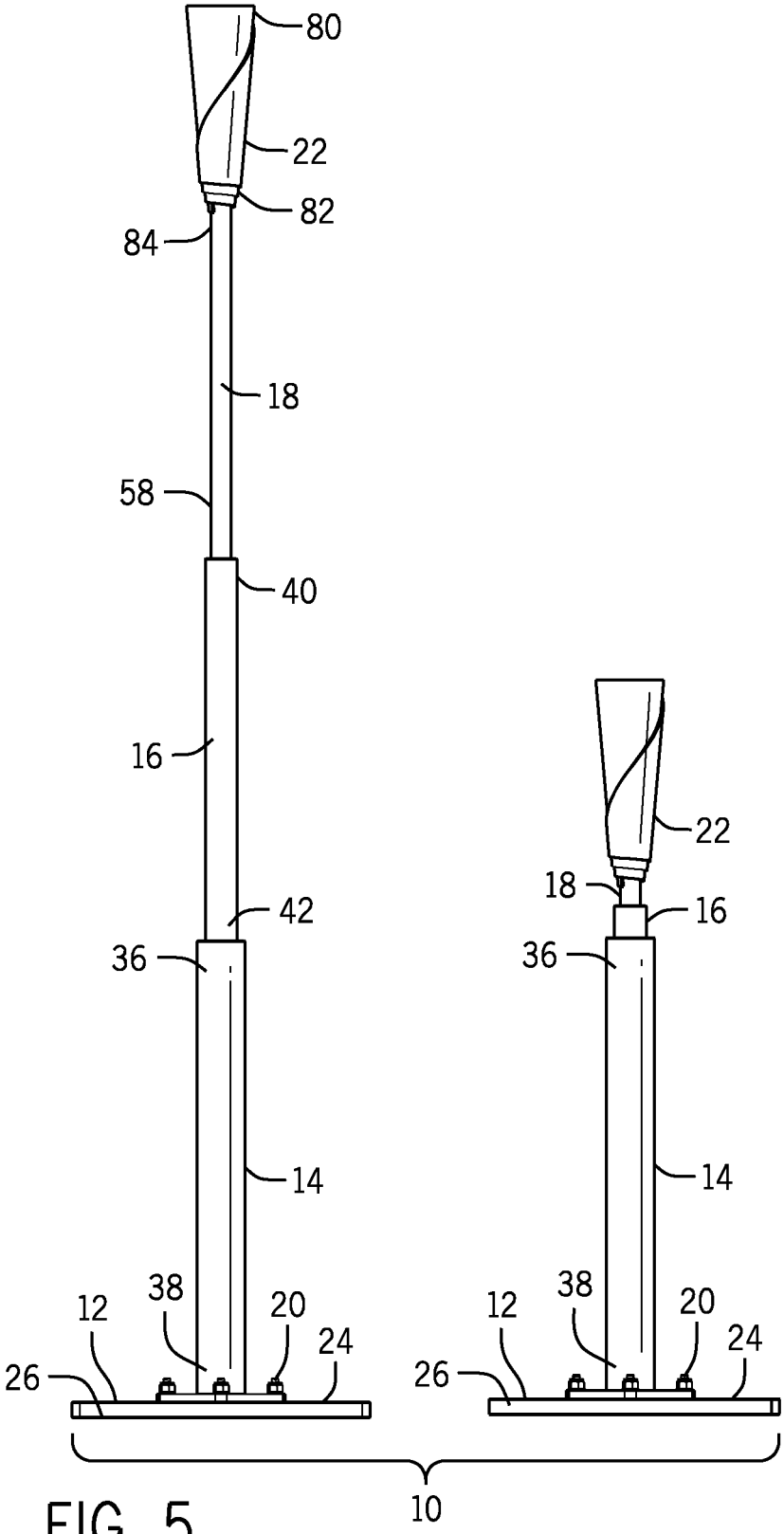
FIG. 5 is a side view of the batting tee assembly of FIG. 4 at a first upper height limit position and at a second lower height limit position.

Referring to FIG. 5, the telescopic engagement of the first, second and third posts 14, 16 and 18 provides the tee assembly 10 with a height adjustment range between upper and lower height limits. The tee assembly 10 allows the height of the ball support 22 be positioned at any location between the upper and lower height limits. The felt piston wipers 44 and 56 enable a user to make height adjustments quickly, easily, reliably and consistently with a single hand. Once adjusted or repositioned, the wipers 44 and 56 maintains the ball support 22 at the same height position consistently during use, even following impact from a swung ball bat. The felt piston wipers 44 and 56 provide sufficient frictional interaction between the first and second posts 14 and 16, and the second and third posts 16 and 18, respectively, to maintain the height position of the tee assembly 10 constant between height adjustments by the user. In one preferred embodiment, the distance between the upper and lower height limits is at least 12 inches. In another preferred embodiment, the distance between the upper and lower limits of the tee assembly 10 is at least 20 inches. In one particularly preferred embodiment, the lower height setting limit is 23 inches and the upper height setting limit is 44 inches measured from the horizontal support surface. In other particularly preferred embodiments, other upper and lower height limits can be used.

Referring to FIGS. 1 and 4, the ball support 22 is a lightweight, impact resistant structure with an upper end 80 configured for supporting a baseball and/or a softball, and a lower end 82 coupled to an upper end 84 of the third post 18. Referring to FIG. 1, the ball support 22 can be a rigid structure. Referring to FIG. 2, the ball support 22 can be a flexible resilient structure, such as a neoprene sheet rolled into a helical twist. In another alternative preferred embodiment, the ball support can include a circular brush with upwardly extending bristles for supporting the ball. The ball support 22 can be formed of an acetal resin. In other embodiments, the ball support can be formed of a neoprene, a nylon, a fiber composite material, a thermoplastic material, an elastomeric material, a rubber, or other high impact resistant materials.

Referring to FIGS. 6 through 9, the post mount mechanism 20 is shown in greater detail. The mount mechanism 20 is fixedly connected to the base 12 and releasably connected to the lower end 38 of the first post 14. The mount mechanism 20 includes a support body 60, a support spacer 62, a releasable expansion plug 64 and upper and lower fastening elements 66 and 68. The support body 60 is a durable strong support structure connected to the base 12. The support body 60 retains the mount mechanism 20 and the remaining portions of the tee assembly 10 in an upright position. The support body 60 can be connected to the base 12 through a set of fasteners 70. The fasteners 70 can be a set of nuts and bolts, or other forms of conventional fasteners. The support body 60 is preferably formed of a steel. Alternatively, other high strength and durable materials can be used. In another alternative preferred embodiment, the support body can be formed integrally with the base such that the base and the support body are inseparable and a one piece structure.

The support spacer 62 is a cylindrical support structure that provides an upper surface that serves as a lower bearing surface for the expansion plug 64. The support spacer 62 is fixedly connected to the support body 60 at its lower end. The support spacer 62 defines the height of the expansion plug 64 with respect to the support surface and its cylindrical shape is sized to fit within the lower end 38 of the first post 14. In one preferred embodiment, the support spacer 62 has a cylindrical outer surface that is slightly smaller than the inner surface of the lower end 38 providing additional support to the first post 14 including side load support. The outer surface of the spacer 62 can be sized to contact the inner surface of the first post 14. The spacer 62 includes a through spacer passage for receiving upper and lower fastening elements 66 and 68. The support spacer 62 can be a separate structure from the support body 60 or integrally formed with the support body 60 such that the components are inseparable.

The releasable expansion plug 64 is a resilient annular body formed of a resilient durable and expandable material, such as a EPDM silicone rubber. In other alternative preferred embodiments, the expansion plug can be form of other rubbers, or other elastomeric materials. The expansion plug 64 includes a central opening for receiving one or both of the upper and lower fastening elements 66 and 68. The expansion plug 64 is sized with an unloaded outer diameter that is approximately the same size as the inner diameter of the lower end 38 of the first tube 14. When unloaded, the expansion plug 64 is configured to enable a user to removably position the expansion plug 64 within the lower end 38 of the first tube 14.

The upper and lower fastening elements 66 and 68 are fasteners configured to be drawn together to compress the expansion plug 64 thereby causing the expansion plug 64 to expand radially. The upper fastening element 66 is preferably an elevator bolt that include a head 72 that engages the upper surface of the expansion plug 64 and a shaft 74 that extends through the expansion plug 64 to operably engage the lower fastening element 68. The lower fastening element 68 can be a tee-handle 76 that extends from the bottom surface 26 of the base 12 through the base and into the spacer 62 to operably engage the upper fastening element 66. The base 12 can include a recess for receiving the tee handle 76 and the lower fastening element 68 enabling the lower surface 26 of the base 12 to remain flush with the horizontal support surface. The tee handle 76 is configured for easy repositioning by a user. The tee handle 76 is sized to provide the user with sufficient mechanical advantage to readily adjust the upper and lower fastening elements 66 and 68 to cause the expansion plug 64 to securely, and as desired releasably, engage the lower end 38 of the first post 14.

In operation, a user can slide the lower end 38 of the first post 14 over the upper fastening element 66, the expansion plug 64 and the spacer 62. The lower end 38 can slide over the mount mechanism 20 until its contacts the support body 60. The user can then reach below the base 12 and grasp the tee handle 76 of the lower fastening element 68. The threaded engagement of the upper and lower fastening elements 66 and 68 enables the head 72 of the upper fastening element 66 to be drawn downward against the upper surface of the expansion plug 64 as the user rotates the tee handle 76. As the upper fastening element 66 continues to be drawn downward the expansion plug 64 is essentially squeezed between the head 72 and the upper surface of the spacer 62 thereby causing the expansion plug 64 to extend radially outward from the longitudinal axis of the first post 14. The outer radial surface of the expansion 64 bears against the inner surface of the first post 14 to securely engage the first post 14 to the mount mechanism 20. The first post 14 remains securely engaged to the mount mechanism 20 until such time that the user desires to release or remove the first post 14 from the mount mechanism 20. The user can release or remove the first post 14 from the mount mechanism 20 by loosening the tee handle 76 which draws the head 72 of the upper fastening element 66 upward decompressing the expansion plus 64. The resilient expansion plug 64 returns to its original shape as the upper and lower fastening elements 66 and 68 are loosened, thereby enabling the user to easily and readily remove the first post 14 from the mount mechanism 20. The mount mechanism 20 provides a user with a quick efficient manner to install and remove the first post 14 from the mount mechanism 20 and the base 12 for moving between practice locations or for transporting in a vehicle.

The post mount mechanism 20 is removably attachable to the first tubular post 14 in a first position wherein the spacer 62, the expansion plug 64 and the upper fastening element 66 are positioned within the lower end 38 of first tubular post 14 and the outer diameter of the expansion plug 64 bears against the inner surface of the first tubular post 14 to fixedly secure the lower end 38 of the first tubular support 14 to the mount mechanism 20, and a second position wherein the first tubular post 14 is movable with respect to, and separable from, the spacer 62 and the expansion plug 64.

In alternative preferred embodiments, the upper and lower fastening elements 66 and 68 can be other forms of fasteners. In one embodiment, the upper fastener can include a large washer for engaging the upper surface of the expansion plug. The lower fastening element can directly engage the lower surface of the expansion plug. The tee handle can be formed in other handle shapes or fastener heads. The mount mechanism can be other structures that are arranged to releasably clamp or compress the expansion plug.

The batting tee assembly 10 of the present invention is readily adjustable, portable, lightweight, durable and easy to use. The tee assembly 10 enables consistent, quick and easy height adjustments over a large adjustment range without degrading overtime. The batting tee assembly 10 of the present invention provides a sleek clean aesthetic that indicates high quality and toughness.

While the preferred embodiments of the invention have been illustrated and described, it will be appreciated that various changes can be made therein without departing from the spirit and scope of the invention. One of skill in the art will understand that the invention may also be practiced without many of the details described above. Accordingly, it will be intended to include all such alternatives, modifications and variations set forth within the spirit and scope of the appended claims. Further, some well-known structures or functions may not be shown or described in detail because such structures or functions would be known to one skilled in the art. Unless a term is specifically and overtly defined in this specification, the terminology used in the present specification is intended to be interpreted in its broadest reasonable manner, even though may be used conjunction with the description of certain specific embodiments of the present invention.

What is claimed is:

1. A portable batting tee assembly comprising:

a first tubular post having a lower end, an upper end and an inner surface;

a second tubular post telescopically engaged with the first tubular post, a ball support coupled to the second tubular post;

a base; and a post mount mechanism including a support body, an expansion plug and upper and lower fastening elements, the support body including a cylindrical bearing portion and a base engaging portion connected to the base, the bearing portion, the expansion plug and the upper fastening element configured to be removably received within the lower end of the first tubular post, the post mount mechanism removably attachable to the first tubular post in a first position wherein the bearing portion, the expansion plug and the upper fastening element are positioned within the lower end of first tubular post and the outer diameter of the expansion plug bears against the inner surface of the first tubular post to fixedly secure the lower end of the first tubular post to the mount mechanism, and a second position wherein the first tubular post is movable with respect to, and separable from, the bearing portion and the expansion plug.

2. The portable batting tee assembly of claim 1, further including a first felt piston wiper positioned between the first and second tubular posts.

3. The portable batting tee assembly of claim 2, wherein the height of the tee assembly is adjustably positionable over a range of at least 12 inches, and wherein the felt piston wiper provides sufficient frictional interaction between the first and second tubular posts to maintain the height of the tee assembly to constant between height adjustments.

4. The portable batting tee assembly of claim 1, wherein a third post telescopically engaged with the second tubular post.

5. The portable batting tee assembly of claim 4, further including a second felt piston wiper positioned between the second and third tubular posts.

6. The portable batting tee assembly of claim 1, wherein the height of the tee assembly is adjustably positionable over a range of at least 12 inches.

7. The portable batting tee assembly of claim 1, wherein the height of the tee assembly is adjustably positionable over a range of at least 20 inches.

8. The portable batting tee assembly of claim 1, wherein the base includes a handle.

9. The portable batting tee assembly of claim 1, wherein the base is configured to support the tee assembly on a horizontal surface, and wherein the base defines a footprint of less than or equal to one square foot.

10. The portable batting tee assembly of claim 1, wherein the base has a polygonal shape.

11. The portable batting tee assembly of claim 10, wherein the polygonal shape is a pentagon.

12. The portable batting tee assembly of claim 1, wherein the ball support is selected from the group consisting of a concave support, a brush tee, and a frustoconical support.

13. The portable batting tee assembly of claim 1, wherein when in the first position, the bearing portion of the post mount mechanism engages the inner surface of the first tubular post.

14. The portable batting tee assembly of claim 1, wherein the first and second tubular posts are cylindrical hollow tubes, and where each of the first and second tubular posts has a constant diameter along its length.

15. An adjustable portable batting tee assembly for placement on to a horizontal support surface, the batting tee assembly comprising:

a first hollow tubular post having a lower end and an inner surface;

a second tubular post telescopically engaged with the first tubular post;

a first felt piston wiper positioned between the first and second tubular posts to enable adjustment of the height of the batting tee assembly between a plurality of heights with respect to the support surface between a lower height limit and an upper height limit;

a ball support coupled to the second tubular post;

a post mount mechanism including a support body, an expansion plug and upper and lower fastening elements, the expansion plug and the upper fastening element configured to be removably received within the lower end of the first tubular post, the expansion plug configured to releasably engage the inner surface of the first tubular post; and a base coupled to the post mount mechanism.

16. The batting tee assembly of claim 15, wherein the upper fastening assembly is an elevator bolt.

17. The batting tee assembly of claim 15, wherein a third post is telescopically engaged with the second tubular post.

18. The batting tee assembly of claim 17, further including a second felt piston wiper positioned between the second and third tubular posts.

19. The batting tee assembly of claim 15, wherein the distance between the upper and lower height limits is at least 12 inches.

20. The batting tee assembly of claim 15, wherein the distance between the upper and lower height limits is at least 20 inches.

21. The batting tee assembly of claim 15, wherein the base includes a handle.

22. The batting tee assembly of claim 15, wherein the base is configured to support the tee assembly on a horizontal surface, and wherein the base defines a footprint of less than or equal to one square foot.

23. The batting tee assembly of claim 15, wherein the base has a shape selected from group consisting of rectangular, pentagonal, hexagonal, octagonal, triangular, circular, oval, other polygonal shapes, and other closed curved shapes.

* * * * *